US006485621B2

(12) United States Patent
Del Rincon et al.

(10) Patent No.: US 6,485,621 B2
(45) Date of Patent: Nov. 26, 2002

(54) CATHODE

(75) Inventors: Eduardo Del Rincon, Pierrefonds (CA); Nosrat Benhood, Pierrefonds (CA)

(73) Assignee: Noranda Inc., Toronto (CA)

( * ) Notice: Subject to any disclaimer, the term of this patent is extended or adjusted under 35 U.S.C. 154(b) by 78 days.

(21) Appl. No.: 09/800,740

(22) Filed: Mar. 8, 2001

(65) Prior Publication Data

US 2002/0139664 A1 Oct. 3, 2002

(51) Int. Cl.[7] ..... C25D 1/00

(52) U.S. Cl. ..... 204/281; 204/286.1; 204/297.01; 204/297.06; 204/279; 29/825; 29/745; 29/746; 29/760; 29/761

(58) Field of Search ..... 204/279, 281, 204/286.1, 297.01, 297.06; 29/825, 745, 746, 760, 761

(56) References Cited

U.S. PATENT DOCUMENTS 5,492,609 A 2/1996 Assenmacher ..... 204/286
5,919,343 A * 7/1999 Sparapani ..... 204/279

* cited by examiner

*Primary Examiner*—Bruce F. Bell
(74) *Attorney, Agent, or Firm*—Goudreau Gage Dubuc

(57) ABSTRACT

An improvement to a cathode used in an electrorefining or electrowinning of copper. The cathode has a solid copper head bar with a horizontal groove on its undersurface. The upper edge of a stainless steel flat sheet has several holes along its width and is vertically inserted into the groove. The stainless steel sheet is then mechanically attached to the copper head bar by pressing the copper head bar against the stainless steel at the perforated points along the head bar. To increase the joint strength, the stainless steel sheet may be welded to the copper head bar at its upper edges at the underside of the head bar.

30 Claims, 1 Drawing Sheet

CATHODE

BACKGROUND OF THE INVENTION

1. Field of Invention

The present invention relates to an improvement to a cathode for use in electrorefining or electrowinning of copper. In particular, the present invention relates to an apparatus and method for plating copper onto a stainless steel sheet that may be attached to a solid copper head bar.

2. Description of the Related Art

Electrorefining is one of the final steps in copper processing. Generally, copper anodes and starting sheets are disposed in an electrolytic solution that comprises of copper sulfate and sulfuric acid. The sheet acts as a cathode and is typically made of stainless steel to deter corrosion during the process. An electric current is passed through the solution causing copper from the positively charged anode to be deposited on the negatively charged sheet. Electrowinning is performed by a similar process, but the copper is removed from solution, rather than from an anode, and deposited on the sheet. When an appropriate amount of copper has been deposited on the sheet, the sheet is removed from the solution and stripped of the copper.

For example, one such method of electrorefining is performed by using a cathode developed by Dremco Specialized Products for Electrowinning and Electrorefining and manufactured by T. A. Caid in Arizona. This method is disclosed in U.S. Pat. No. 5,492,609 (incorporated herein by reference). The stainless steel sheet in this cathode is attached to the copper head bar by means of a filet welding along a horizontal groove on the underside of the head bar after the upper edge of the stainless steel sheet is inserted into the groove. The weld size is around three to four millimeters wide using copper filler metal.

However, this welding formulation has several problems and disadvantages. Dissimilar metal fusion welding involves the melting and mixing of metals, usually with the addition of a filler metal. Because the metallurgical and physical properties of copper and stainless steel differ significantly (e.g., copper and stainless steel have different melting points, thermal and electrical conductivities, and coefficients of thermal expansion), certain problems arise as a result of the welding.

For example, the substantial difference in the melting temperatures of copper and stainless steel causes segregation of the base metals upon weld solidification. The higher melting temperature metal will solidify first, leaving the lower-melting constituents segregated. Also, the variation in the coefficients of thermal expansion (CTE) of the metals can cause the development of stresses due to shrinkage. This can cause hot cracking problems. Moreover, penetration of liquid copper into the stainless steel grain boundaries can occur and this is known to cause solidification cracking.

There is another problem that arises with the welding of copper and stainless steel. Copper and stainless steel are resistant to copper electrolyte. However, the weld metal also uses a copper filler metal, which is a mixture of stainless steel and copper. This mixture has a lower corrosion resistance than the parent metals. Therefore, because the weld metal is neither copper nor stainless steel—but is instead a mixture of both—it has a lower corrosion resistance than its parent metals. In addition, it is possible that galvanic corrosion will occur in the weld metal due to the segregation of copper and stainless steel in the weld metal.

Finally, yet another drawback of existing cathodes is the occurrence of crevice corrosion of the stainless steel inside the groove. Crevice corrosion of stainless steel occurs when electrolytes enter into the groove in the gap between the stainless steel sheet and copper hanger bar as a result of weld corrosion.

These problems lead to cracking at the ends of the weld joint between the copper hanger bar and stainless steel sheet. Finite element analyses of the cathodes currently in use reveal that both ends of the cathodes are exposed to high stress concentrations. These high stresses are the result of operating parameters that include exposing the weld joint to various impacts. For example, the cathodes are subjected to both static and dynamic loads during transportation, as well as during the processes of stripping the deposited copper off the stainless steel sheet.

Furthermore, continued dissolution of weld metal due to corrosion and its subsequent separation from the stainless steel reduces the amount of contact surfaces between the stainless steel sheet and copper head bar. Crevice corrosion of the stainless steel sheet inside the groove also reduces the amount of contact between the stainless steel sheet and copper head bar. These reductions in contact area negatively affect the current density, which in turn negatively affects the rate of production.

SUMMARY OF THE INVENTION

It is an object of the present invention to address some of the above-listed problems and thereby prolong the life of the cathode.

Briefly, according to the present invention, the cathode has a groove that is preferably deeper than the known cathode on the underside of the head bar. A stainless steel flat sheet with several punched holes is preferably inserted into the groove, and then the copper head bar can be pressed against the stainless steel sheet at the points where the stainless steel sheet is perforated. As a result of localized pressing, copper extrudes into the holes in the stainless steel sheet. This ensures contact between the copper head bar and stainless steel sheet and lessens the role of the weld joint between the bar and the sheet.

In one aspect of the present invention a cathode is provided for electrolytic copper refining. The cathode comprises a copper head bar having a horizontal groove on an undersurface and a stainless steel sheet that has a plurality of holes at an upper end thereof, the upper end of said sheet being disposed in the horizontal groove of said copper head bar and copper from said copper head bar being disposed inside the plurality of holes at the upper end of said sheet to form a mechanical bond between said copper head bar and said sheet.

In another aspect of the present invention a method for making a cathode is provided. This method comprises the steps of (1) inserting a stainless steel sheet, said sheet comprising a plurality of holes at an upper end thereof, into a copper head bar by placing the upper end of said sheet into a horizontal groove located on an undersurface of said copper head bar and (2) pressing said copper head bar against said sheet in such a manner that copper from said copper head bar flows into the plurality of holes at the upper end of said sheet causing a mechanical bond between said copper head bar and said sheet.

In yet another aspect of the present invention there is provided a method for making a cathode comprising the steps of (1) forming a plurality of holes at an upper end of a stainless steel sheet, (2) forming a horizontal groove in an undersurface of a copper head bar, (3) inserting the upper end of said sheet into the horizontal groove of said copper head bar, and (4) localized pressing of said copper head bar at locations that correspond to the locations of the plurality of holes in said sheet.

Other objects, features, and advantages of the present invention will become apparent from the following detailed description taken in conjunction with the accompanying drawings.

DETAILED DESCRIPTION OF THE PREFERRED EMBODIMENT

Figure 3:
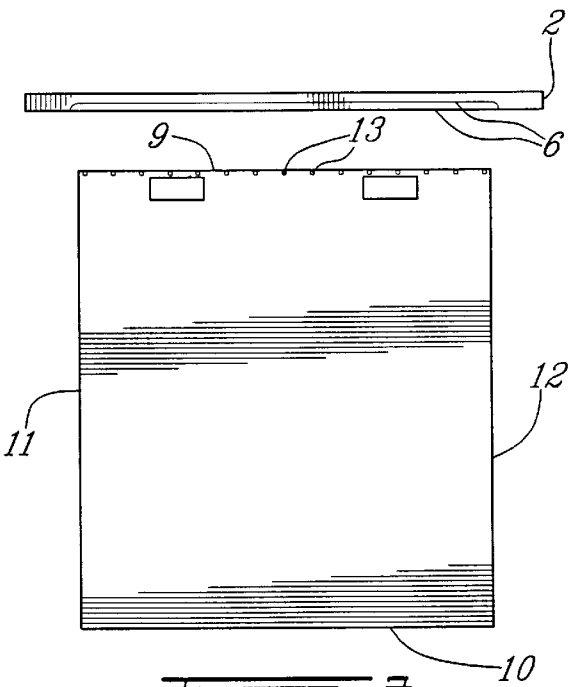
FIG. 3 is an exploded view of the stainless steel sheet (3) and head bar (2) assembly forming the cathode of the present invention.
Figure 2:
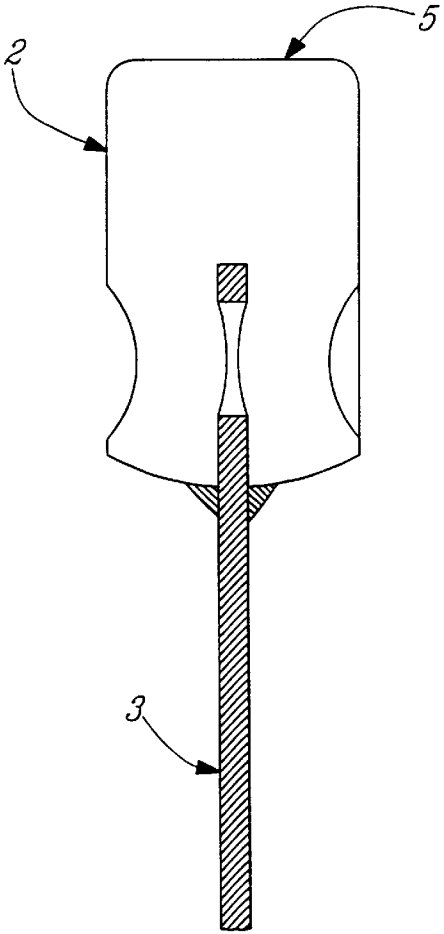
FIG. 2 is a sectional view through the head bar (2).
Figure 1:
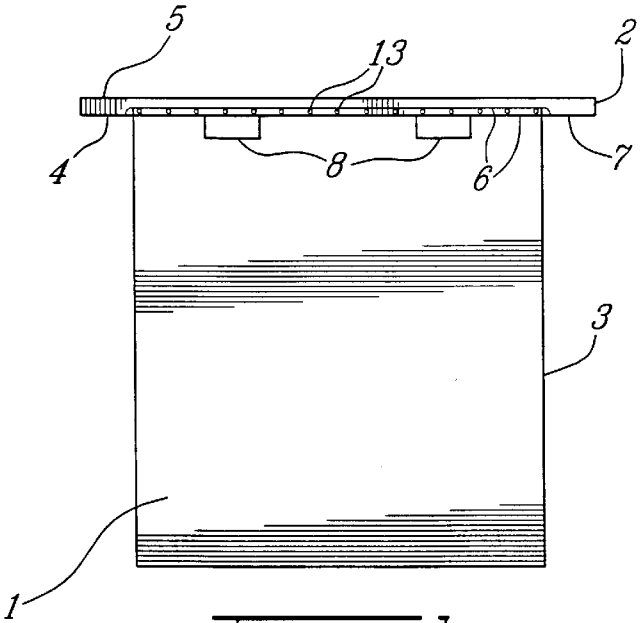
FIG. 1 is front elevation view of the cathode of the present invention.

In FIGS. 1–3, the cathode (1) of the present invention preferably includes a high conductivity copper head bar (2) that is attached to a flat stainless steel sheet (3). As explained in detail below, the stainless steel sheet may be attached the copper head bar by pressing the head bar against the stainless steel. In addition, the joint between the head bar and the stainless steel sheet can be further strengthened by welding along the stainless steel top edge.

EXAMPLE 1

The head bar (2) is made of rectangular solid high conductivity copper bar. To have a high strength, the copper bar is cold rolled up to 20% during production. The head bar (2) has a rectangular cross-section and a slightly rounded underside surface (4) so that the center of gravity of the head bar (2) is such that the head bar hangs vertically. The head bar has a flat upper side (5). The head bar (2) of Example 1 is 60" long, 1.5" high and 1' wide. The groove (6) on the underside surface (4) of the head bar has a rectangular cross-section that is preferably 16–19 mm deep (in this particular example it was 18.65 mm deep) and 3 mm wide.

The stainless steel used in this cathode should be AISI 316 low carbon Grade L. Its surface finish should be 2B or better, as per specification ASTM A 240. The thickness of the sheet should be about 11 gauge. The steel has about 0.03% by weight carbon, 12% by weight nickel, 17% by weight chromium and about 2.25% molybdenum.

To avoid copper deposition onto the edges (11 & 12), which can create problems during the stripping process of the deposited copper, the edges may be masked using a suitable plastic, such as edge strip. An edge strip is a plastic bar with a groove in one side that is pushed against the vertical edge of the stainless steel sheet. The plastic bar can be made of polyethylene or chlorinated polyvinyl chloride (CPVC) or other suitable materials.

As shown in FIG. 1, the head bar (2) is also designed such that the length of the groove is slightly longer than the width of the stainless steel sheet (3). The groove does not extend through the support portions (7) of the head bar (2). In addition, the opposite ends of the head bar (7) extend laterally beyond the side edges (11 & 12) of the sheet (3) to permit seating of the head bar (2) on electrical support contacts in an electrowinning or electrorefining cell.

The stainless steel sheet has two lifting windows (8) of 127 mm×50.1 mm (or 5" by 2") with a distance 9 mm from the center of the punched holes (13). When the stainless steel sheet (3) is inserted into the head bar (2), the top edges of the lifting windows are flashed with the underside surface (4) of the head bar (2). In an alternative arrangement, the window top edge is spaced from the underside surface of the head bar. In conventional cathodes, windows are punched with no top edge. However, in the present invention, windows are punched as complete rectangles for which the top horizontal side of a rectangle corresponds with the underside surface of the head bar. This will protect the underside surface (4) of the head bar (2) from abrading with contact by the lift truck blades, and will allow the electrode weight to be supported by the window top edge, or a combination of the window top edge and the underside surface of the head bar.

The stainless steel sheet (3) has a square shape. The sheet is 1066.8 mm (42") high and 965.2 mm (38") wide so that the width of the sheet (3) is slightly longer than the length of the groove (6), as described above. The sheet (3) has an upper edge (9), a lower edge (10), and vertical side edges (11), (12).

The sheet (3) has 15 equally spaced holes (13) at the upper end (9), with each hole having a diameter of 11–12.7 mm (0.4"–0.5") and positioned 66 mm (2.6") apart from each other above the lifting windows (8). These holes were drilled, but these holes could be created by any of a variety of known techniques (e.g., the holes could also be punched).

The purpose of these holes (13) is to allow copper from the head bar (2) to flow into the holes (13) as a result of a pressing process. The pressing process used is, preferably, open die forging during which a spherical tool is forced against the copper head bar at both sides of the head bar. The applied compressive force is about 15,000 lbf. This force is exerted on the head bar where the holes are present on the stainless steel sheet. In other words, the pressing force is localized at the location of the holes. In this example, the force was applied one hole at a time and on one side at a time. Of course, this is not required and it is contemplated that the pressing process could be performed in a variety of manners using a variety of techniques.

A detailed view of the plastic deformation that resulted from the pressing process is shown in FIG. 2. The copper that flows into the holes (13) provides a mechanical bond between the head bar and the sheet. The extent of the bond is such that the cathode (1) may be used without welding the stainless steel sheet (3) to the head bar (2).

However, welding will further increase the contact and bond strength making the cathode more durable. For example, in a pull test the bond strength between the head bar and the stainless steel sheet is compared and the results are as depicted in Table 1.

TABLE 1

| | |
|---|---|
| Conventional cathode | 6760 lbf (3066 Kgf) |
| Cathode of the present invention (without welding) | 6760 + 1940 = 8700 lbf (3946 Kgf) |

Another advantage of the present invention is the fact that it minimizes the role of the dissimilar weld while increasing contact and, therefore, electrical conductivity between the copper hanger bar (2) and the stainless steel sheet (3).

If welding is desired, dissimilar welds between the head bar (2) and the stainless steel sheet (3) can be made by gas metal arc welding (GMAW) using deoxidized copper (99% copper) with the least impurity under a 100% argon shielding gas.

The present invention can be practiced in other various forms without departing from the spirit and scope of the invention. In other words, the foregoing description of embodiments has been given for illustrative purposes only and is not to be construed as imposing any limitations in any respect.

The scope of the invention is, therefore, to be determined solely by the following claims and is not to be limited by the text of the specification. Accordingly, alterations that are made that are equivalent to the scope of the claims fall within the true spirit and scope of the invention.

We claim:

1. An electrolytic copper refining cathode comprising:

a copper head bar having a horizontal groove on an undersurface; and a stainless steel sheet having a plurality of holes at an upper end thereof, the upper end of said sheet being disposed in the horizontal groove of said copper head bar and copper from said copper head bar being disposed inside the plurality of holes at the upper end of said sheet to form a mechanical bond between said copper head bar and said sheet.

2. A cathode according to claim 1, further comprising a weld between said sheet and the undersurface of said copper head bar.

3. A cathode according to claim 1, wherein the horizontal groove of said copper head bar is about 16–19 mm deep.

4. A cathode according to claim 1, further comprising edge strip attached to both vertical edges of said sheet.

5. A cathode according to claim 1, wherein the undersurface of said copper head bar is slightly rounded.

6. A cathode according to claim 1, wherein said sheet further comprises one or more lifting windows.

7. A cathode according to claim 6, wherein said lifting windows are positioned such that an upper surface of said lifting windows is below the undersurface of said copper head bar.

8. A cathode according to claim 7, further comprising a weld between said sheet and the undersurface of said copper head bar.

9. A cathode according to claim 7, wherein said sheet comprises two lifting windows.

10. A cathode according to claim 9, wherein said lifting windows are rectangular in shape and approximately 5 inches wide by 2 inches high.

11. A method for making a cathode comprising the steps of:

inserting a stainless steel sheet, said sheet comprising a plurality of holes at an upper end thereof, into a copper head bar by placing the upper end of said sheet into a horizontal groove located on an undersurface of said copper head bar;

pressing said copper head bar against said sheet to cause copper from said copper head bar to flow into the plurality of holes at the upper end of said sheet causing a mechanical bond between said copper head bar and said sheet.

12. A method for making a cathode according to claim 11, further comprising the step of welding said sheet to said copper head bar.

13. A method for making a cathode according to claim 11, further comprising the step of attaching edge strip to both vertical edges of said sheet.

14. A method for making a cathode according to claim 11, wherein said pressing step is performed by the use of a spherical punching tool.

15. A method for making a cathode according to claim 11, wherein the horizontal groove is about 16–19 mm deep.

16. A method for making a cathode according to claim 11, wherein said sheet comprises one or more lifting windows.

17. A method for making a cathode according to claim 16, wherein said lifting windows are positioned such that an upper surface of said lifting windows is located at a distance from the upper end of said sheet that is greater than the depth of the horizontal groove of said copper head bar.

18. A method for making a cathode according to claim 17, wherein said lifting windows are rectangular in shape and approximately 5 inches wide by 2 inches high.

19. A method for making a cathode according to claim 17, further comprising the step of welding said sheet to said copper head bar.

20. A method for making a cathode according to claim 19, wherein said welding step is performed by gas metal arc welding using deoxidized copper.

21. A method for making a cathode comprising the steps of:

forming a plurality of holes at an upper end of a stainless steel sheet;

forming a horizontal groove in an undersurface of a copper head bar;

inserting the upper end of said sheet into the horizontal groove of said copper head bar; and localized pressing of said copper head bar at locations that correspond to the locations of the plurality of holes in said sheet.

22. A method for making a cathode according to claim 21, further comprising the step of welding said sheet to said copper head bar.

23. A method for making a cathode according to claim 21, further comprising the step of attaching edge strip to both vertical edges of said sheet.

24. A method for making a cathode according to claim 21, wherein said horizontal groove is formed so that the depth of said horizontal groove is about 16–19 mm.

25. A method for making a cathode according to claim 21, further comprising the step of forming one or more lifting windows in said sheet.

26. A method for making a cathode according to claim 25, wherein said forming lifting windows step involves positioning an upper surface of said lifting windows such that the upper surface is located at a distance from the upper end of said sheet that is greater than the depth of the horizontal groove of said copper head bar.

27. A method for making a cathode according to claim 26, wherein said lifting windows are punched from said sheet.

28. A method for making a cathode according to claim 27, wherein said lifting windows are rectangular in shape and approximately 5 inches wide by 2 inches high.

29. A method for making a cathode according to claim 26, further comprising the step of welding said sheet to said copper head bar.

30. A method for making a cathode according to claim 29, wherein said welding step is performed by gas metal arc welding using deoxidized copper.

* * * * *

UNITED STATES PATENT AND TRADEMARK OFFICE

CERTIFICATE OF CORRECTION

PATENT NO. : 6,485,621 B2
DATED : November 26, 2002
INVENTOR(S) : Del Rincon et al.

It is certified that error appears in the above-identified patent and that said Letters Patent is hereby corrected as shown below:

Column 3,
Line 39, "1' wide." should read -- 1" wide --. So line 39, reads -- 60" long, 1.5" high and 1" wide. The groove (6) on the --.

Signed and Sealed this

Twentieth Day of May, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,485,621 B2
DATED : November 26, 2002
INVENTOR(S) : Del Rincon et al.

It is certified that error appears in the above-identified patent and that said Letters Patent is hereby corrected as shown below:

Title page,
Item [75], the name of the inventor "Benhood" should read -- Behnood --.

Signed and Sealed this

Twentieth Day of January, 2004

JON W. DUDAS
*Acting Director of the United States Patent and Trademark Office*